US006623078B2

(12) United States Patent
Chu et al.

(10) Patent No.: US 6,623,078 B2
(45) Date of Patent: Sep. 23, 2003

(54) ADJUSTABLE HEIGHT CHAIR ARM SUPPORTED ON BACK UPRIGHT

(75) Inventors: Zooey C. Chu, Grand Rapids, MI (US); David J. Lambert, Madison, TN (US)

(73) Assignee: First Source Furniture Group LLC, Nashville, TN (US)

( * ) Notice: Subject to any disclaimer, the term of this patent is extended or adjusted under 35 U.S.C. 154(b) by 0 days.

(21) Appl. No.: 09/999,217

(22) Filed: Nov. 30, 2001

(65) Prior Publication Data

US 2002/0158500 A1 Oct. 31, 2002

Related U.S. Application Data

(60) Provisional application No. 60/287,320, filed on Apr. 30, 2001.

(51) Int. Cl.[7] ..... A47C 7/54

(52) U.S. Cl. ..... 297/411.36; 297/411.25; 297/411.29

(58) Field of Search ..... 297/411.36, 411.25, 297/411.29, 411.26, 411.24, 411.27, 411.28, 411.44, 411.45

(56) References Cited

U.S. PATENT DOCUMENTS

| | | | | | |
|---|---|---|---|---|---|
| 560,547 | A | | 5/1896 | Shotwell | |
| 766,484 | A | | 8/1904 | Armstrong | 297/411.25 |
| 1,826,643 | A | | 10/1931 | Anderson | |
| 2,091,733 | A | | 8/1937 | Hemminger et al. | |
| 2,584,732 | A | * | 2/1952 | Okun | 297/411.25 |
| 2,602,488 | A | * | 7/1952 | Conning | 297/411.25 |
| 2,725,928 | A | | 12/1955 | Branick | |
| 4,616,877 | A | | 10/1986 | Slaats et al. | 297/353 |
| 4,872,727 | A | | 10/1989 | Rye | 297/411.36 |
| 5,366,276 | A | | 11/1994 | Hobson et al. | 297/411.36 |
| 5,921,630 | A | * | 7/1999 | Cassaday | 297/411.36 X |
| 6,030,037 | A | | 2/2000 | Ritch et al. | 297/239 |
| 6,386,636 | B2 | * | 5/2002 | Caruso et al. | 297/411.36 X |
| 2002/0158496 | A1 | * | 10/2002 | Chu et al. | 297/411.36 X |
| 2002/0158500 | A1 | * | 10/2002 | Chu et al. | 297/411.36 |

* cited by examiner

*Primary Examiner*—Rodney B. White
(74) *Attorney, Agent, or Firm*—Flynn, Thiel, Boutell & Tanis, P.C.

(57) ABSTRACT

A chair having adjustable height arms includes a rigid chair frame having first and second uprights. A back is attached to the chair frame and includes upper and lower ends. A seat is also attached to the chair frame and is adjacent the lower end of the back. Cantilevered to each of the first and second uprights is an arm assembly that projects outwardly therefrom adjacent opposite sides of the seat. Each arm assembly includes a coupling structure that is releasably engaged with a respective upright and is configured to release from the upright when the arm assembly is tilted upward relative to the respective upright to permit the elevational position of the arm assembly to be adjusted.

19 Claims, 9 Drawing Sheets

ADJUSTABLE HEIGHT CHAIR ARM SUPPORTED ON BACK UPRIGHT

RELATIONSHIP TO OTHER APPLICATION

This application claims priority under 35 USC §119(e) of copending provisional application Serial No. 60/287,320 filed Apr. 30, 2001, the entire disclosure of which is herein incorporated by reference.

FIELD OF THE INVENTION

This invention relates to a chair of the type used in offices and the like, and in particular to an improved arm construction having an increased range of height adjustability.

BACKGROUND OF THE INVENTION

Conventional chairs used in offices and the like are typically provided with height-adjustable arms, nevertheless the range of height adjustment is normally small, typically about two to four inches. Further, the range of height adjustment of the arms is such that disposition of the arms even in their lowermost height-adjusted position is such as to interfere with storage of the chair under a worksurface or tabletop since the arms frequently contact the understructure of the tabletop and hence prevent the chair from being moved under the worksurface for most compact storage.

It is an object of this invention to provide an improved office-type chair, as aforesaid, which has height-adjustable chair arms which can be adjusted over a significant and much larger range of height, not only improving the overall comfort and usability of the chair, but also enabling the arms when in their lowermost height-adjusted position to be disposed at an elevation which is substantially at or just above the upper surface of the chair seat, whereby this hence enables the chair to be more readily moved into a storage position beneath a worksurface or tabletop, including movement of the arms into a position beneath the worksurface or tabletop, to permit more compact storage of the chair when not in use.

SUMMARY OF THE INVENTION

This invention is directed to a new and useful chair including a rigid chair frame having first and second uprights. A back is attached to the chair frame and includes upper and lower ends. Also attached to the chair frame is a seat that is adjacent the lower end of the back. An arm assembly is cantilevered to each of the first and second uprights and projects outwardly therefrom adjacent opposite sides of the seat. Each of the arm assemblies includes a releasable coupling mechanism that is engaged with a respective upright and is configured to permit the elevational position of the arm assembly to be adjusted.

Other objects and purposes of the invention will be apparent to persons familiar with constructions of this type upon reading the following specification and inspecting the accompanying drawings.

DETAILED DESCRIPTION

Figure 1:
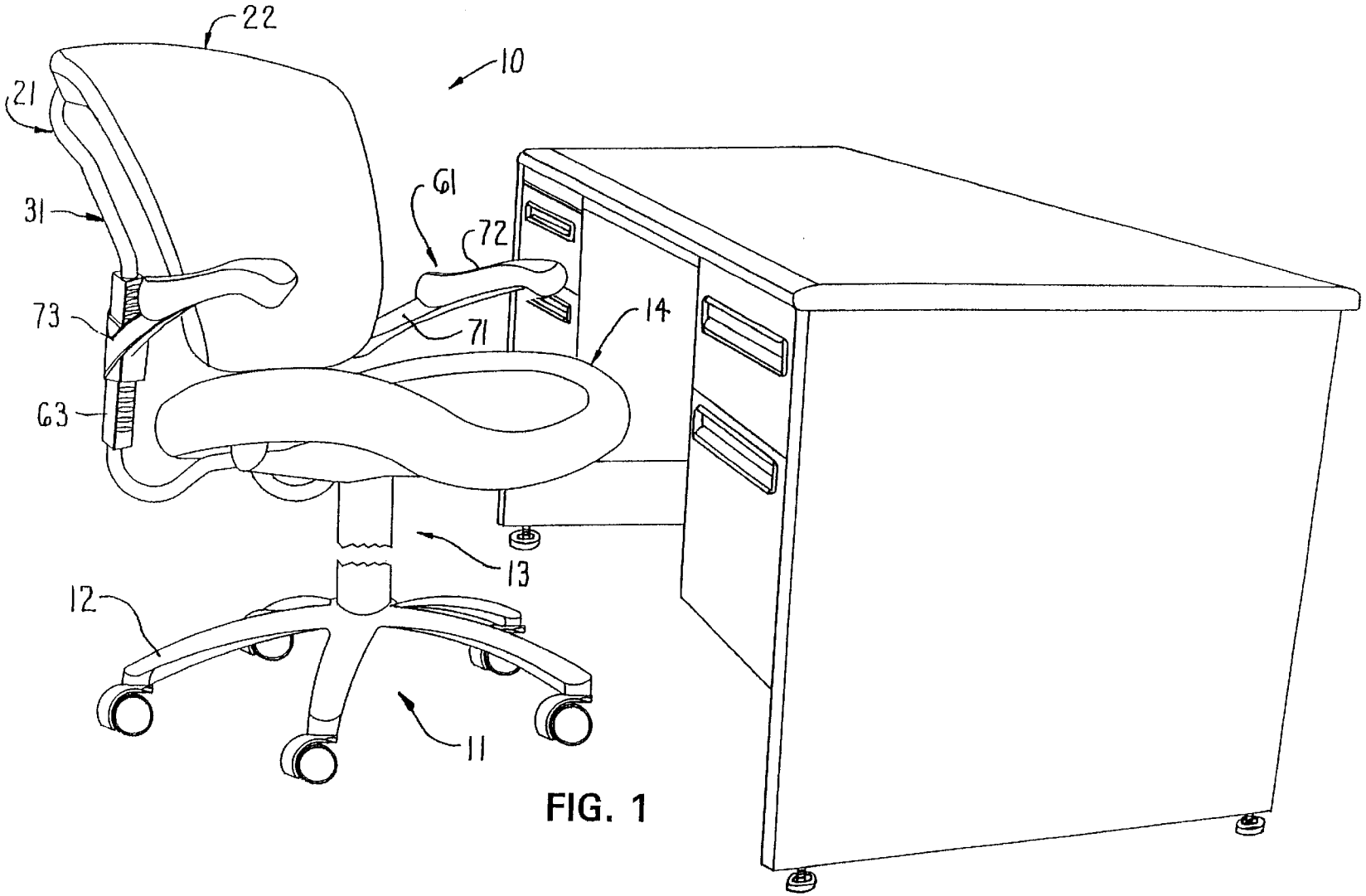
FIG. 1 is a perspective view of a chair according to the present invention shown positioned adjacent a conventional desk.
Figure 2:
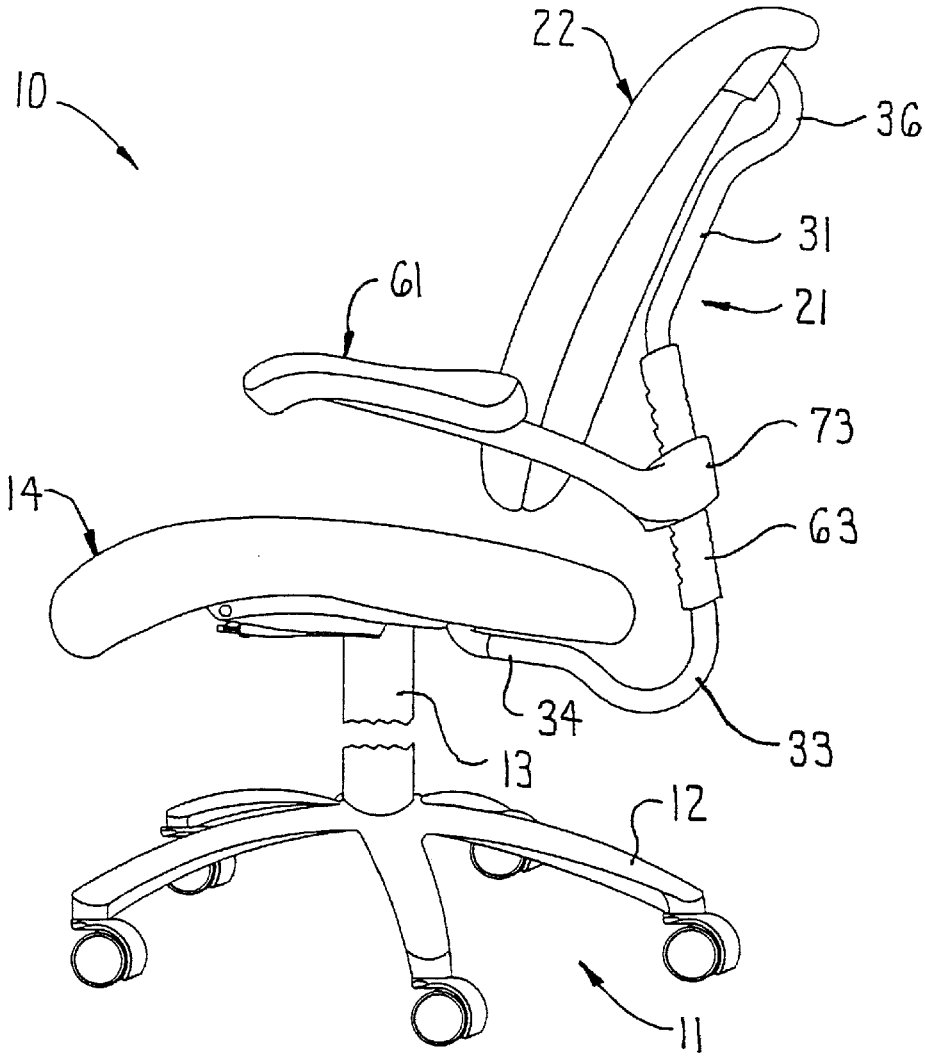
FIG. 2 is a side view of the chair shown in FIG. 1.
Figure 3:
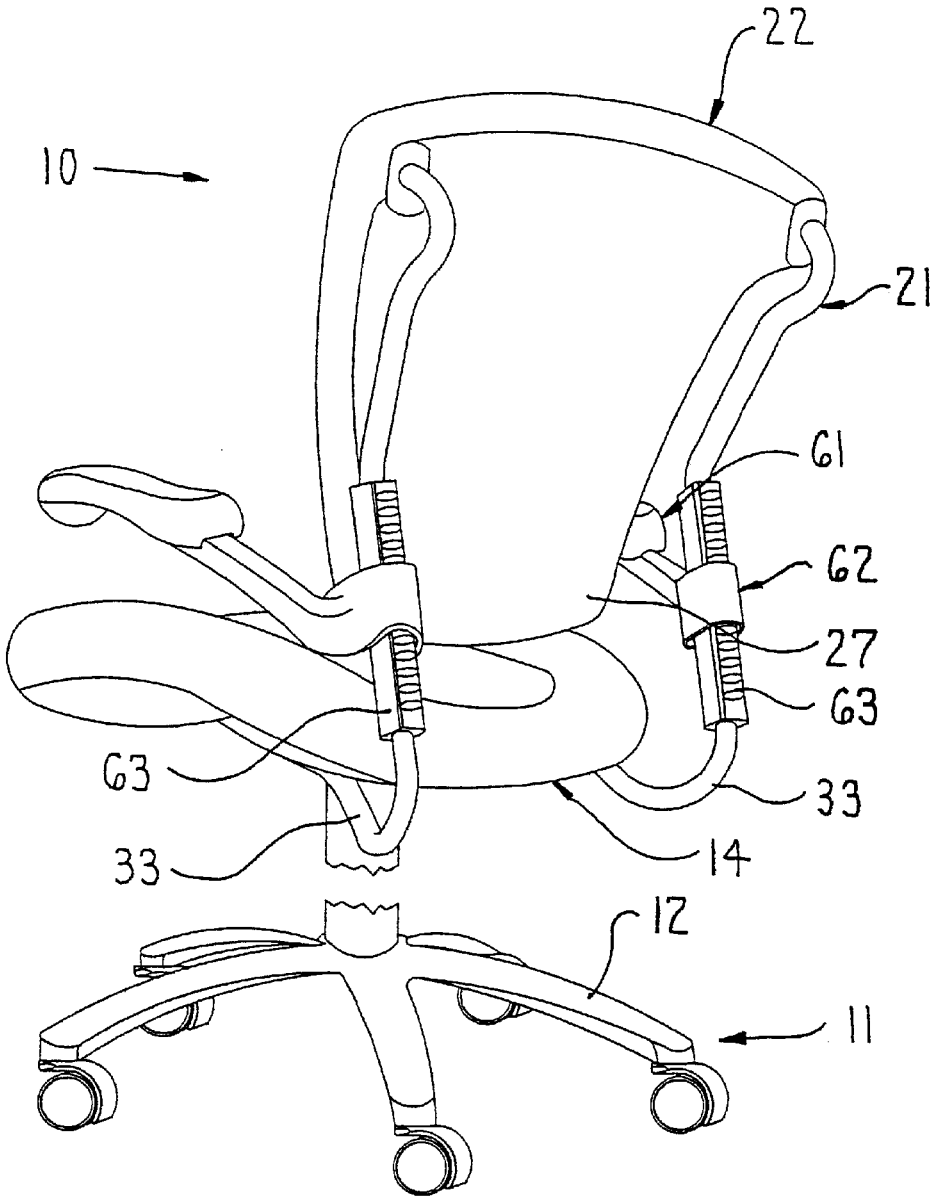
FIG. 3 is a further perspective view taken generally from the rear of the chair shown in FIG. 1.

Referring to FIGS. 1–3, there is illustrated a chair 10 according to the present invention. This chair includes a conventional base 11 having legs 12 and a central height-adjustable pedestal 13 projecting upwardly therefrom. The pedestal at its upper end connects to the underside of a generally horizontally enlarged seat arrangement 14. The seat arrangement 14, as is generally conventional, includes a generally rigid structural inner shell 15 having a cushion thereover 16, with the cushion and shell being generally enclosed by a surrounding covering such as a fabric or vinyl covering.

A back frame structure 21 joins to the underside of the seat structure 14 and projects upwardly for supportive engagement with a back arrangement 22 which projects upwardly from the seat arrangement 14 in the vicinity of the rear edge thereof. This back arrangement 22, in the illustrated embodiment of the invention, has chair arms 61 associated therewith, which chair arms are cantilevered forwardly from the back frame arrangement 21 and are mounted for height adjustment with respect thereto.

The back arrangement 22 includes an inner structural shell 23 typically constructed of wood or rigid plastic, and this inner shell is appropriately covered on a front side thereof with a cushion 24 such as of plastic foam, and the inner shell and foam cushion are appropriately enclosed within an outer covering of fabric, vinyl or the like. The rear of the back arrangement is typically closed by a rear cover or shell 27 which overlies the inner structural shell and is secured thereto. The general construction of the back arrangement 22, like the seat arrangement, is conventional.

Figure 4:
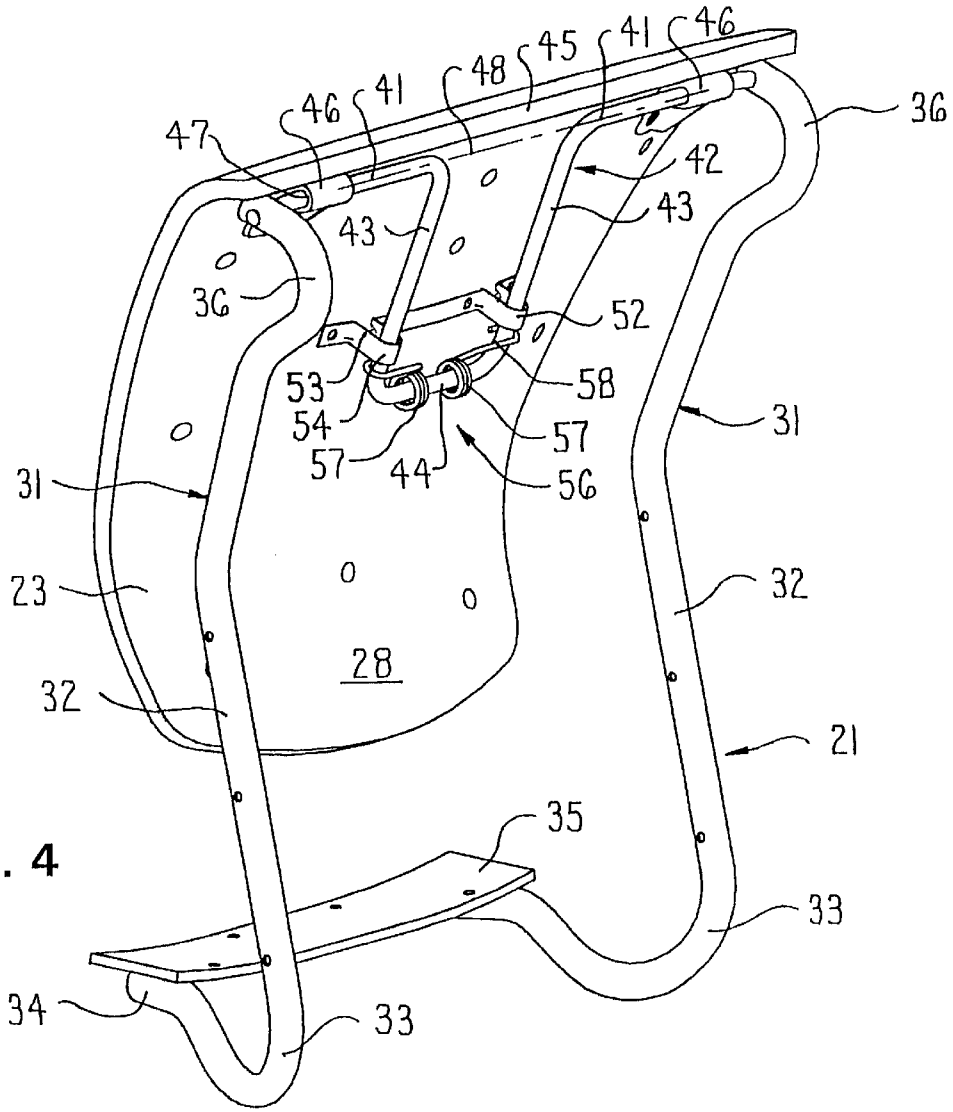
FIG. 4 is a perspective view which illustrates solely the back frame for the chair back of this invention and its connection to the rear inner shell of the chair back.
Figure 6:
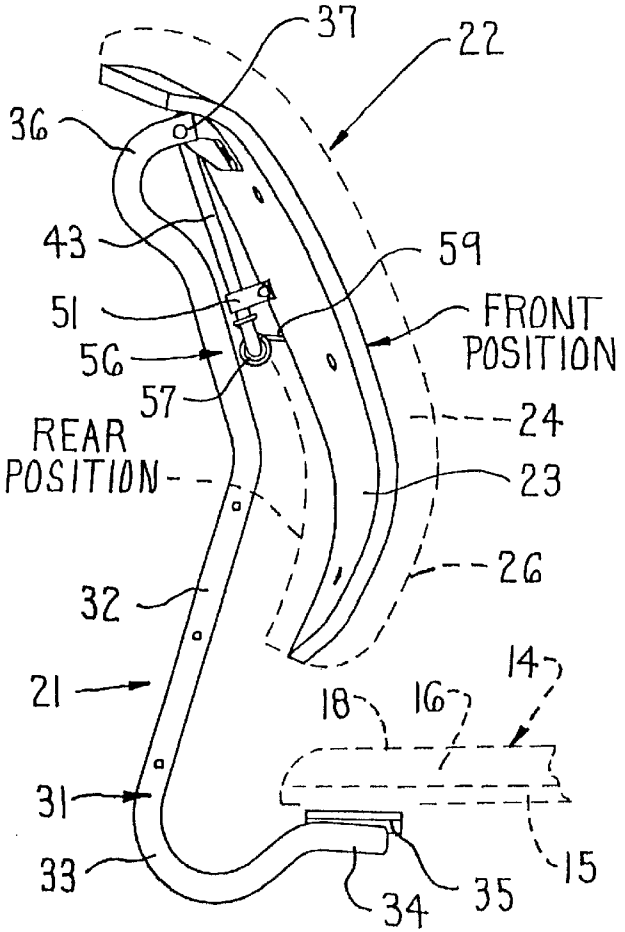
FIG. 6 is a side elevational view of the arrangement shown in FIGS. 4 and 5.
Figure 5:
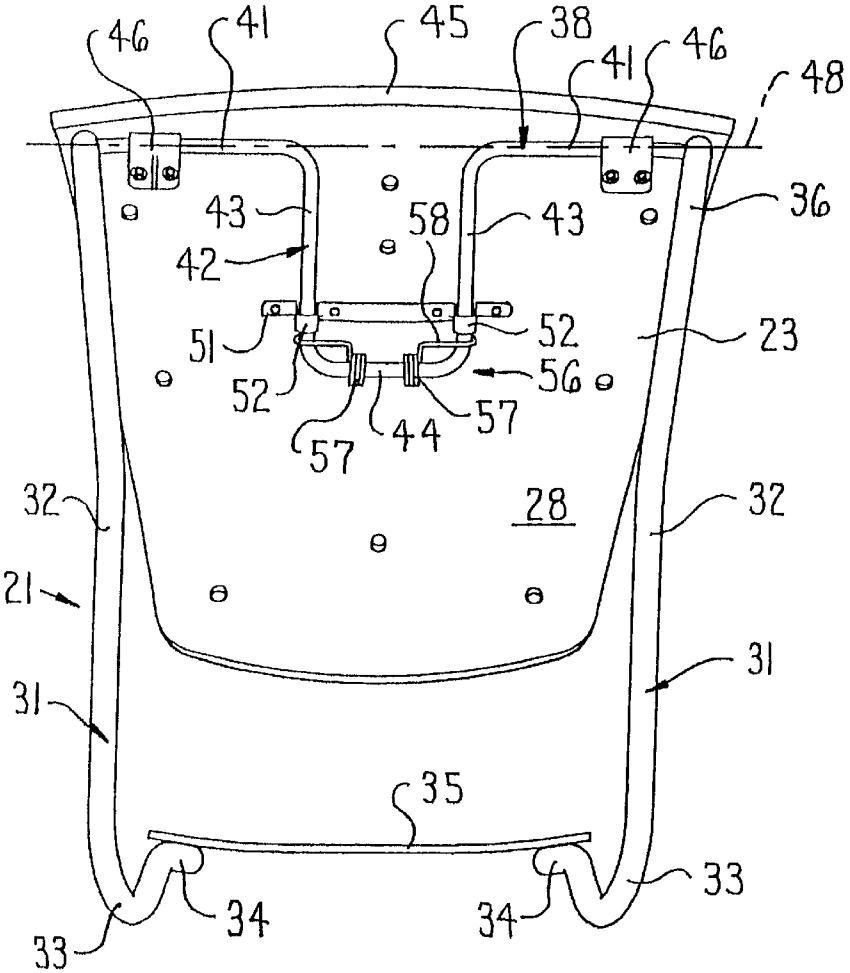
FIG. 5 is a back elevational view of the construction illustrated in FIG. 4.

The back frame arrangement 21 as illustrated in FIGS. 4–6 includes a pair of generally upright frame members 31 which are substantially identical except for being mirror images of one another so as to be disposed adjacent the right and left sides of the chair back. Each upright frame member 31 includes a main elongate center part 32 which extends generally vertical and which at a lower end joins to a curved portion 33 which projects forwardly so as to terminate at a lower free end part 34. The lower free end parts 34 of the upright frame members 31 are rigidly joined by a cross strap or plate 35, the latter in turn being fixedly secured to the underside of the structural shell 15 associated with the seat arrangement 14. The upright frame members 31, at the upper ends thereof, are also provided with curved portions 36 which form an upper leg which projects toward and terminates in a free end 37 disposed adjacent the rear surface 28 of the inner back shell 23 in the vicinity of the upper edge 45 thereof.

The pair of sidewardly-spaced upright frame members 31, at their upper ends, are rigidly joined by a top cross rod or bar 38 which has the free ends thereof non-rotatably and fixedly joined to the upper free end parts 37 of the side frame members 31. This cross bar 38, extending inwardly from the free ends thereof, has generally aligned and substantially horizontally extending rod portions 41 which project inwardly from the side frame members toward the center of the back shell. These horizontal rod members 41 are bent through about 90° angles and joined to a generally U-shaped center rod portion 42. This center rod portion 42 includes side legs 43 which project generally vertically downwardly adjacent the rear surface of the back shell 23, and these side legs 43 join through generally right angle bends to a bottom cross rod 44 which extends generally horizontally. The cross bar 38 and its rigid securement between the upper ends of the spaced side frame members 31, and the bottom strap 35 and its rigid securement between the lower ends of the side frame members 31, thus define a rigid frame assembly which is of a generally closed endless configuration, and provides a connection to support the back arrangement 22 from the seat arrangement 14 as described hereinafter.

To connect the back arrangement 15 to the frame arrangement, the back shell 23 fixedly mounts thereon, in the vicinity of the upper corners thereof, a pair of sidewardly spaced journals or bearings 46 which are fixed to and project outwardly from the rear surface 28 of the back shell 23. This pair of spaced journals 46 define aligned openings 47 therein in which are snugly but rotatably accommodated the horizontal rod parts 41 of the cross bar 38. This connection of the horizontal rod parts within the journals secured to the back shell thus couples the back shell 23, and hence the back arrangement 22, to the frame assembly 21 while permitting relative pivoting of the back arrangement 22 about the longitudinally extending horizontal axis 48 defined by the horizontal rod parts 44.

To control and limit the amount of pivoting movement of the back arrangement 22 relative to the back frame assembly 21 about the pivot axis, the back assembly 22 has a restraining member 51 fixedly secured to and projecting rearwardly from the rear surface of the back shell 23 at an elevation which is spaced downwardly a substantial distance below the horizontal pivot axis 48. This restraining member 51 in the illustrated arrangement is formed generally as a horizontally elongate strap which is fixedly secured to the back shell 23, and the strap has a pair of control parts 52 in sidewardly spaced relationship therealong. These control parts 52 are formed generally as U-shaped parts, or yokes, and effectively extend around and provide control over the vertical rod portions 43. More specifically, each of the control yokes 52 has generally parallel side legs 53 which are spaced apart so as to permit the side rods 43 to move lengthwise of the control yoke until restricted by the closed end 54 of the yoke which is spaced from the rear surface 28 of the seat shell 23 and functions as a stop. These control yokes 51 thus permit the back shell 23 to pivot about the horizontal pivot axis 48 through a limited extent as permitted by the vertical rods 43 abutting the ends of the yokes 52 as a forward limit position, and by the shell 23 swinging rearwardly into a rearwardmost position in which it effectively abuts the U-shaped center rod part 42. The forward and rearward positions are diagrammatically indicated in FIG. 6.

The back arrangement 22 is normally maintained in its forwardmost position by the urging of a spring arrangement 56 which, in the illustrated embodiment, comprises two coil-type torsion springs 57 which surround the horizontal center rod part 44 and have one leg 58 thereof anchored to the rod, with the other leg 59 of each torsion type coil spring being in abutting engagement with the rear surface of the back shell 23. The legs 59 of the torsion springs which project inwardly for contact with the back shell 23 are, in the preferred embodiment, joined together to define a generally U-shaped configuration which bears against the rear surface of the seat shell at a location disposed in the vicinity of the horizontal rod part 44 and hence vertically approximately at the middle of the back shell. The contact of the spring against the seat shell is thus spaced a substantial distance downwardly from the pivot axis 48 and hence, acting through the long lever arm defined between the pivot axis and the spring, urges the seat shell 23 forwardly into the forward position as limited by the vertical rods 43 contacting the stop parts 54 defined at the ends of the control yokes 52.

When the chair of this invention is not occupied, the spring 56 will normally urge the back arrangement 22 forwardly (counter-clockwise in FIG. 6) about axis 48 into the forwardmost position for the back. When the chair is occupied, however, and the occupant leans against the back in the normal manner, the force imposed on the back 22 by the occupant will overcome the spring force and the back will swing back (clockwise) into its rearwardmost position wherein the back shell 23 abuts the U-shaped rod part 42 and thus defines a generally solid or rigid back assembly.

However, if the occupant leans forwardly and relieves the force against the back 22, such as when carrying out an intensive task on a table, such as a keyboarding function, then the back of the occupant will partially move away from the back and relieve the load on the back. At the same time, however, the spring 56 acting against the back shell 23 causes the lower portion of the back 22 to pivot forwardly about the top hinge axis 48, and thus the lower portion of the back 22 will be disposed so as to continue to maintain supportive engagement with at least the lower portion of the occupant's back, particularly in the lumbar area.

Since the torsion springs 57 and their reaction against the rear surface of the back shell 23 occurs at a point which is spaced downwardly a substantial distance below the hinge axis 48, the springs 57 acting through the large lever arm created by this spacing thus results in creation of a significant mechanical advantage so that a rather significant moment can be applied to the back 22 about the pivot axis 48, even though the individual torsion springs themselves are small, and thus a significant force urging the lower portion of the back 22 forwardly can be achieved so as to continue to maintain partial supportive contact with the lower region of the occupant's back.

At the same time, however, the overall mechanism is small and compact, and can be easily enclosed in a small space defined between the inner structural back shell 23 and the outer rear cover 27.

Considering now the construction and operation of the height-adjusting chair arms 61 as associated with the chair of this invention, each height-adjusting chair arm 61 includes an elongate support sleeve 63 which is fixed to and encircles the vertically extending portion 32 of the respective side frame member 31 over a significant extent of the length thereof. This tubular support member 63 has an opening therethrough for snugly receiving therein the elongate straight portion 32 of the side frame member 31, and the tubular support member 63 is formed in two halves which enable it to be snugly clamped around the side frame member and then secured thereto by screws or similar fasteners which extend through the two halves of the support member as well as the side frame member.

The tubular support member 63 has an exterior configuration which is preferably polygonal and is defined by a plurality of flat sides, which exterior polygonal configuration in the preferred embodiment is generally rectangular and more specifically square.

The exterior front side wall 64 of the support tube 63 has a toothed or racklike configuration formed thereon throughout the vertical extent thereof, whereby adjacent teeth 65 are vertically separated by a notch or recess 66 which extends transversely (i.e. generally horizontally) with the upper side of this notch merging smoothly into a ramplike surface which slopes outwardly and upwardly to define the tooth.

The opposite or rear flat wall 67 of the support tube 63 is generally flat but also has a toothed or rack-like configuration formed by a series of transversely (i.e. horizontally) extending notches or recesses 68 formed therein. The series of notches 68 are disposed in vertically spaced relationship along the support tube, with the vertical spacing between adjacent notches 68 generally corresponding to the vertical spacing between adjacent recesses 66 associated with the front wall of the support tube 63.

The upright back frame members 31 are disposed substantially totally exteriorly of the back arrangement 22, and the elongate vertical uprights 32 associated with the back frame members 31 are disposed so that they are positioned closely adjacent but spaced slightly rearwardly and slightly outwardly from opposite sides of the back arrangement 22. Each of the elongate vertical upright portions 32 of the back frame elements 31, specifically those portions having the support tubes 63 secured therearound, support thereon one of the cantilevered arm assemblies 61.

Each cantilevered arm assembly 61 includes a generally horizontally elongate arm member 71 which is mounted on and projects forwardly from the respective support tube 63, with this arm member in turn having a top cap member or arm rest 72 fixedly mounted thereon, which top cap member typically incorporates some type of resilient cushioning material enclosed within an appropriate exterior cover, such as is conventional, so that further description thereof is believed unnecessary. The arm rest 72 provides a supportive engagement with the forearm and/or hand of the chair occupant in a conventional manner.

Figure 8:
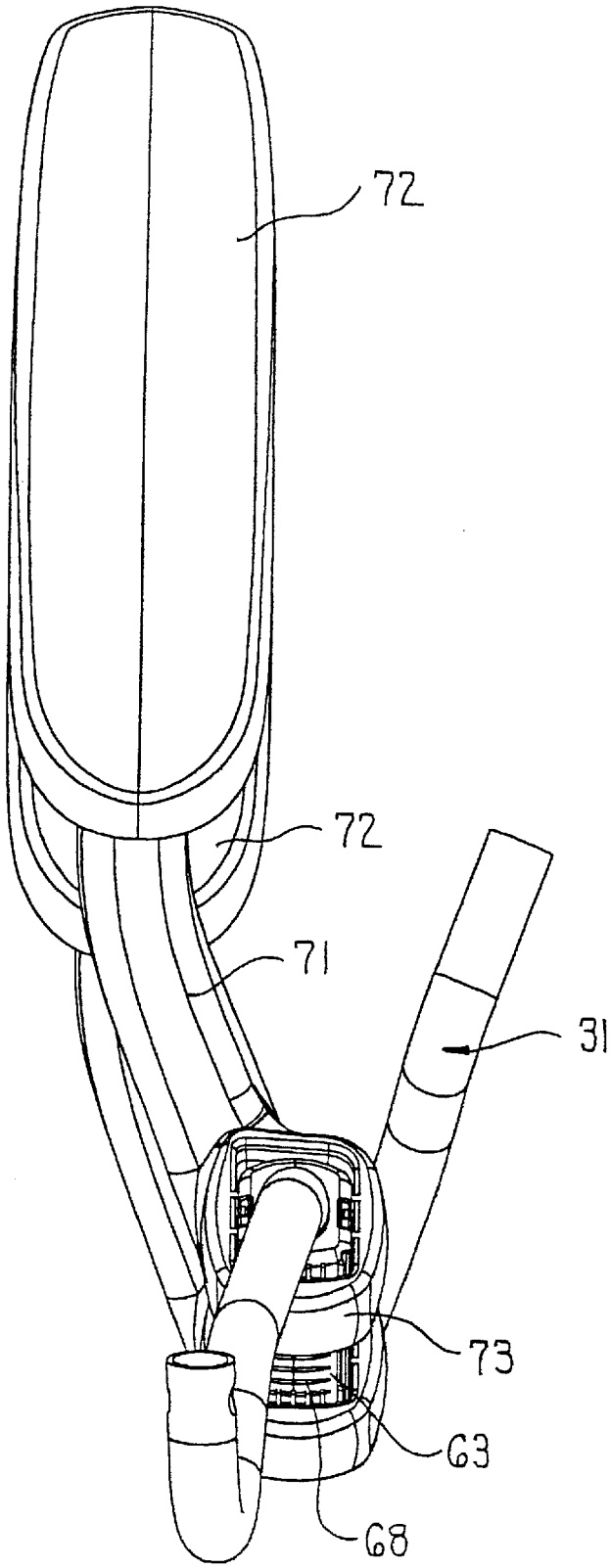
FIG. 8 is a top view of the arrangement shown in FIG. 7 and showing both positions of the chair arm in solid lines.

The arm member 71 at the rearward end thereof is provided with a sleeve part 73 which has an opening 74 extending vertically therethrough, the cross section of which is noncircular and is sized so as to nonrotatably but vertically axially accommodate therein the respective support tube 63, as illustrated in FIG. 8.

The sleeve part 73 defines thereon, on the front side of the interior opening 74 adjacent the lower end thereof, a transversely extending rib 75 which projects rearwardly into the interior of the sleeve part and is sized so as to engage a selective one of the recesses 66 defined between the teeth 65 on the front or rack-bearing side of the support tube 63.

The rear side of the opening 74, in the vicinity of the upper end thereof, has a further rib 76 which extends transversely and projects outwardly in a forward direction so as to terminate in a generally flat outer end. This latter projection 76 is adapted to bear against the rear surface 67 of the support tube 63 in the flat regions between the notches 68. This rear projection 76 is also disposed vertically upwardly a substantial distance above the front projection 75, as illustrated by FIG. 7.

The support hub 73 on the arm member 71 also has a small platelike spring 77 which is mounted interiorly thereof and has a cantilevered portion which terminates in a free end part 78 adapted to resiliently engage one of the latching notches 68 formed on the rear wall of the support tube 63. This spring 77 has the upper end thereof secured over the rear support rib 76 associated with the support hub 73 so that the spring 77 is fixed to and hence carried with the support hub 73. The spring 77 as it projects downwardly is cantilevered so as to be resiliently urged forwardly so that the end part 78 is always positioned for engagement with the rear wall 67 of the support tube 63, and is engaged with one of the recesses or notches 68 when the arm member 71 is in a use position.

Figure 7:
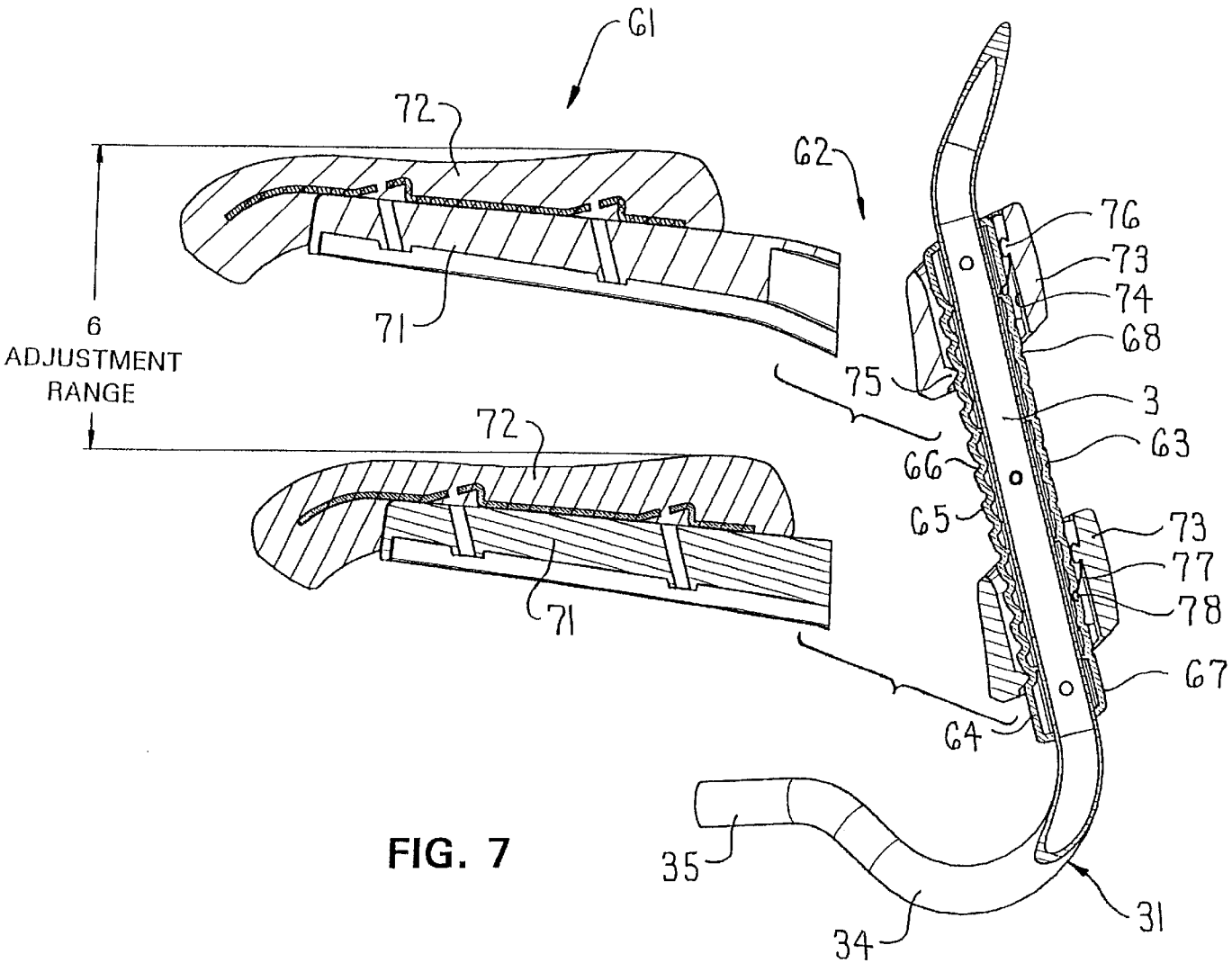
FIG. 7 is a side elevational view showing in cross sectional view the chair arm and its connection to the upright associated with the back frame, and specifically showing in solid lines the chair arm in both its uppermost and lowermost height adjusted positions.
Figure 9:
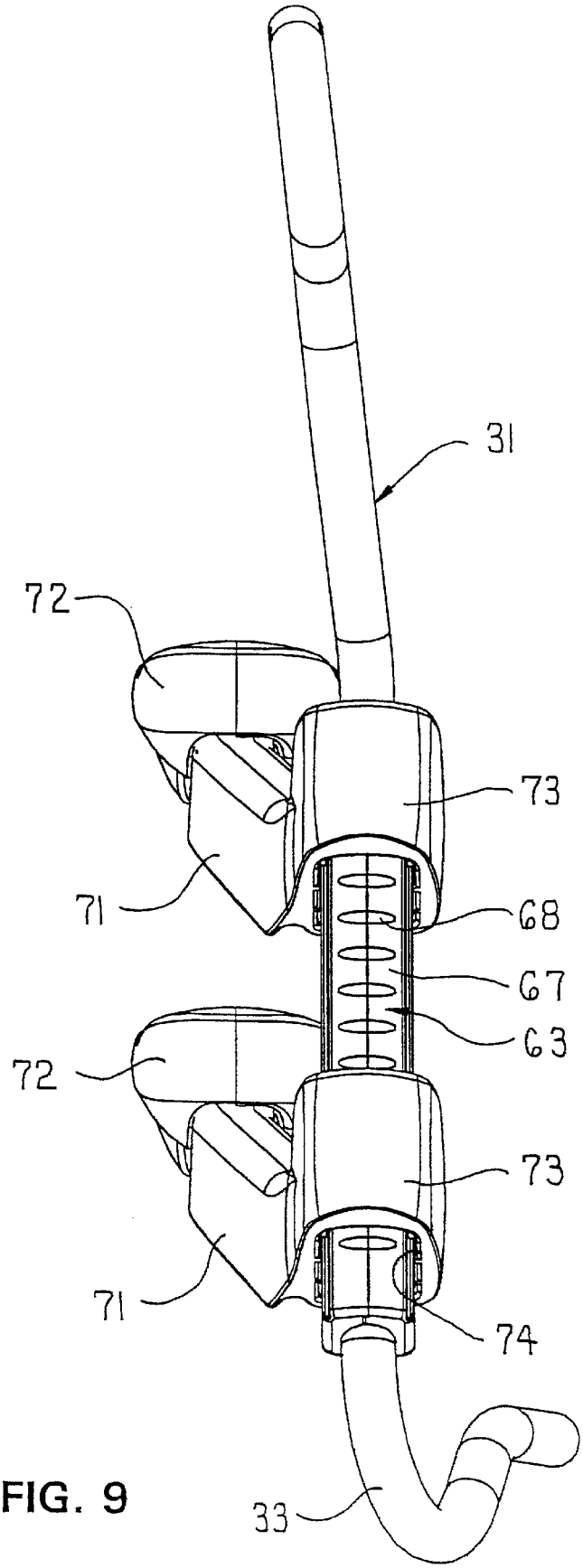
FIG. 9 is a rear elevational view of the arrangement shown in FIGS. 7–8 and again showing both elevational positions of the chair arm in solid lines.
Figure 10:
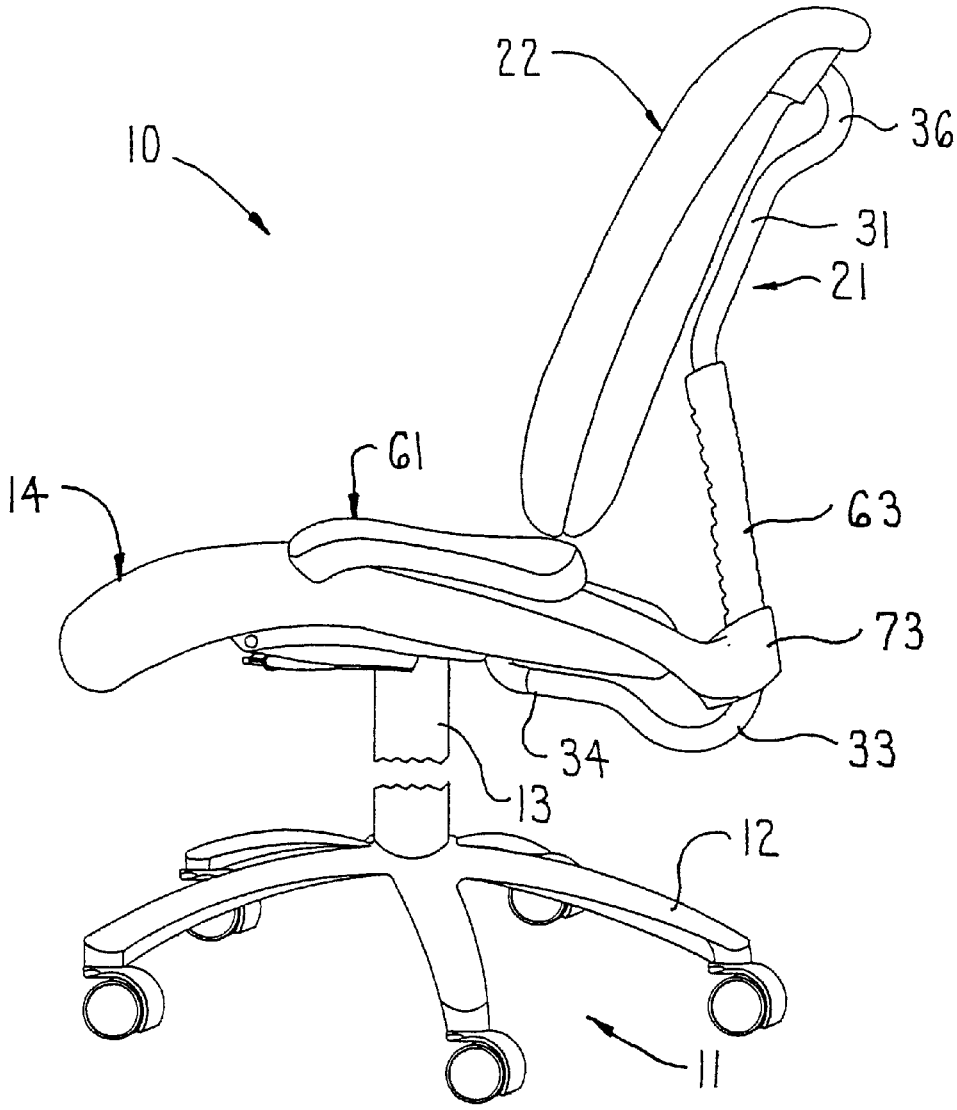
FIG. 10 is a side view of the chair illustrated in FIG. 1 showing the chair arms in their lowermost elevational positions.

With the height-adjusting arm arrangement of the present invention, the individual arms can each be vertically adjusted in height from an uppermost position as illustrated in FIGS. 7–9 to the lowermost position illustrated therein. This height adjustment range is preferably between about seven inches, with the arm when at the upper limit as illustrated in FIGS. 7–9 typically being at the uppermost height which is conventionally provided for arms associated with office type chairs. Conversely, however, when the arm is in the lowermost position illustrated in FIGS. 7–9, the arm is now disposed so that it is positioned closely adjacent the outer side edges of the seat arrangement 14, and elevationally is positioned closely adjacent or just slightly above the upper surface of the seat arrangement, as illustrated in FIG. 10, whereby in this latter position the arms are at an elevation whereby they are compactly stored directly adjacent the seat arrangement, and thus the chair in its entirety, except for the back arrangement, can be readily stored in a position under even low tabletops or worksurfaces. Further, even when the chair is occupied, the arms can be disposed in this lowermost position whereby they do not interfere with the occupant's movements if the occupant prefers to have the sides of the chair seat free of obstructions.

The operation of the height-adjusting arms is extremely simple since, if the occupant when sitting in the chair grips the arm 71 such as adjacent the router end thereof and lifts upwardly, this causes the arm to vertically tilt or rock about the bearing rib 76, thereby causing the lower locking rib 75 to be withdrawn from engagement with the notches 66 of the front rack and further causing the upper rib 76 to be withdrawn from the notches 68 of the rear rack. When in this position, the spring 77 carried on the upper rib 76 is still engaged with the rear notch rack on the upright tube 63. The operator can then move the arm vertically, either upwardly or downwardly, since the spring 77 will merely function like a releasable detent and effectively "click" upwardly or downwardly along the support tube 63 and hence define the various locking positions. When the arm reaches the desired elevational position, the operator then allows the arm to tilt back downwardly causing the locking rib 75 to engage the respective recess 66 associated with the rack, thereby relocking the arm in the selected position, substantially in the manner illustrated by FIG. 7. In this locking position, the weight of the arm tending to swing it downwardly (counterclockwise in FIG. 7) thus effectively maintains the support hub 73 of the arm in locked engagement with the support tube 63. No additional complex locking mechanisms are required, and in addition no separate levers or trigger mechanisms are required so as to release the arm for height adjustment purposes.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a rigid chair frame including first and second uprights;

a back attached to said chair frame and including upper and lower ends;

a seat attached to said chair frame adjacent said lower end of said back;

arm assemblies respectively cantilevered to said first and second uprights and projecting outwardly therefrom adjacent opposite sides of said seat;

each said arm assembly including a coupling structure releasably engaged with said respective upright and configured to release from said upright when said arm assembly is tilted upward relative to said respective upright to permit the elevational position of said arm assembly to be adjusted;

each of said first and second uprights including front and rear exterior surfaces, said front exterior surface of each said upright including a plurality of vertically-spaced recesses;

each of said arm assemblies having an opening sized to receive said respective upright, said opening having front and rear interior sides;

each said coupling structure including a front transverse rib that projects adjacent a lower end of said front interior side of said opening and engages one of said plurality of recesses on said front exterior surface of said respective upright; and each said coupling structure including a rear transverse rib that projects adjacent an upper end of said rear interior side of said opening and bears against said rear exterior surface of said respective upright.

2. The chair according to claim 1, wherein each said arm assembly is free of independently movable release and locking components.

3. The chair according to claim 1, wherein each releasable coupling structure is configured to lock said respective arm assembly in a particular elevational position when said arm assembly is tilted downward relative to said respective upright such that said front transverse rib engages one of said plurality of recesses.

4. The chair according to claim 1, wherein each of said arm assemblies is movable to an elevational position that is adjacent a side surface of said chair seat.

5. The chair according to claim 1, wherein said arm assembly includes an elongate tubular support member fixedly positioned around each of said first and second uprights;

a plurality of recesses are included on a front exterior surface of said support member; and a further plurality of vertically-spaced recesses defined in the rear exterior surface of said support member and cooperating with the rear transverse rib.

6. A chair comprising:

a rigid chair frame including first and second uprights;

a back attached to said chair frame and including upper and lower ends;

a seat attached to said chair frame adjacent said lower end of said back;

arm assemblies respectively cantilevered to said first and second uprights and projecting outwardly therefrom adjacent opposite sides of said seat;

each of said first and second uprights including a support member having front and rear exterior surfaces, and said front exterior surface of each support member includes a plurality of recesses;

each said arm assembly having an opening sized to receive said respective support member, said opening having front and rear interior sides; and each of said arm assemblies including a fixed coupling structure releasably engaged with said respective upright, the coupling structure including a front transverse rib fixed to said arm assembly and projecting from adjacent a lower end of said front interior side of said opening and engaging one of said plurality of recesses on said front exterior surface of said respective support member, and a rear transverse rib fixed to said arm assembly and projecting from adjacent an upper end of said rear interior side of said opening and bearing against said rear exterior surface of said respective support member wherein said coupling structure is configured to permit the elevational position of said arm assembly to be adjusted relative to said respective upright and is free of independently movable release and locking components.

7. The chair according to claim 6, wherein said coupling structure is configured to allow adjustment of the elevational position of said arm assembly when said arm assembly is tilted angularly upward relative to said respective upright into a release position, and wherein said coupling structure is configured to lock said respective arm assembly in a generally horizontally oriented elevational position when said arm assembly is tilted downward relative to said respective upright from said release position.

8. The chair according to claim 6, wherein each of said arm assemblies is movable to an elevational position that is adjacent a side surface of said chair seat.

9. A chair comprising:

a base for engagement with a floor, a seat mounted on said base, and a back projecting upwardly from a position adjacent a rear edge of said seat;

first and second uprights positioned adjacent opposite sides of said back;

first and second arms respectively mounted on said first and second uprights and cantilevered forwardly therefrom so as to be positioned adjacent opposite sides of the seat, each said arm mounting thereon an upwardly facing arm rest for supportive engagement with an occupant's forearm or hand; and a releasable connecting structure cooperating between each said arm and the respective said upright for normally maintaining the arm in a generally horizontally oriented stationary use position relative to the upright and for permitting the arm to be manually released from the upright and moved vertically therealong in response to upward vertical tilting of the arm relative to the upright;

said connecting structure including a first rearwardly protruding protrusion fixed to said arm and cooperating with one of a vertically-spaced plurality of recesses provided on a forwardly-facing surface of the respective upright, and a second forwardly-protruding protrusion fixed to said arm and cooperating with one of a plurality of vertically-spaced recesses associated with a rearwardly facing surface of the respective upright.

10. A chair according to claim 9, wherein the first and second protrusions as fixedly associated with the respective arm are disposed in both horizontally and vertically spaced relationship with respect to one another.

11. A chair according to claim 9, wherein said arm adjacent a rearward end thereof has an opening extending vertically therethrough for accommodating the respective upright therein, said first protrusion is provided adjacent a front side of said opening adjacent a lower end thereof, and said second protrusion is provided adjacent a rear side of said opening adjacent an upper end thereof.

12. A chair according to claim 11, wherein said upright includes a vertically elongate rodlike member having an elongate arm-engaging sleeve fixedly positioned thereon in surrounding relationship thereto, said sleeve having a non-circular cross section including front and rear facing walls provided with said first and second series of recesses respectively associated therewith.

13. A chair according to claim 12, wherein a spring detent is engaged between said arm and said sleeve.

14. A chair comprising:

a base for engagement with a floor, a seat mounted on said base, and a back projecting upwardly from a position adjacent a rear edge of said seat;

first and second uprights associated with and positioned adjacent opposite sides of said back;

first and second arms respectively mounted on said first and second uprights and cantilevered forwardly therefrom so as to be positioned adjacent opposite sides of the seat, each said arm mounting thereon an upwardly facing arm rest for supportive engagement with an occupant's forearm or hand;

a releasable connecting structure cooperating between each said arm and the respective said upright for normally maintaining the arm in a generally horizontally oriented stationary use position relative to the upright and for permitting the arm to be manually released from the upright and moved vertically therealong in response to upward vertical tilting of the arm relative to the upright;

said connecting structure includes a first rearwardly-protruding protrusion fixed to said arm and cooperating with an opposed forwardly-facing surface of the respective upright, and a second forwardly-protruding protrusion fixed to said arm and cooperating with an opposed rearwardly-facing surface of the respective upright, at least one of said surfaces being provided with a plurality of vertically-spaced recesses so that the respective protrusion is engaged with one of the recesses when the arm is in the stationary use position; and a spring detent mounted on said arm and having a resiliently-biased part which is maintaining in engaged relationship with one of said recesses and which slidably engagably moves vertically along the plurality of recesses when said arm is manually moved vertically while in a tilted position.

15. A chair according to claim 14, wherein the first and second protrusions as fixedly associated with the respective arm are spaced vertically a substantial distance apart with respect to one another.

16. A chair according to claim 15, wherein the other of said surfaces is provided with a plurality of vertically-spaced recesses which cooperate with the other protrusion.

17. A chair according to claim 14, wherein said resiliently-biased part of said spring detent and said one protrusion are engaged with different ones of said recesses.

18. A chair according to claim 14, wherein said back is carried on and extends transversely between said uprights, and each said arm being independently vertically movable along the respective upright between a raised use position wherein the arm rest is a substantial distance above the seat for engagement with the forearm of a seated occupant and a lowered storage position wherein the arm rest is positioned closely adjacent the upper surface of the seat adjacent one side thereof so that the region above the seat adjacent the side thereof is substantially unobstructed.

19. A chair according to claim 14, wherein each said arm assembly is free of independently movable release and locking components.

* * * * *